United States Patent [19]

Brooks

[11] Patent Number: 4,817,646

[45] Date of Patent: Apr. 4, 1989

[54] METHOD AND APPARATUS FOR CLEANING MINI BLINDS

[76] Inventor: Milo Brooks, 2821 Brundage La., Bakersfield, Calif. 90304

[21] Appl. No.: 80,061

[22] Filed: Jul. 31, 1987

[51] Int. Cl.[4] ..... B08B 30/00

[52] U.S. Cl. ..... 134/26; 134/10; 134/25.1; 134/25.5; 134/29; 134/31; 134/39; 134/40; 134/137; 15/302; 15/303; 15/306 R; 15/308

[58] Field of Search ..... 15/303, 302, 306 R, 15/308; 134/10, 25.1, 25.5, 26, 29, 31, 39, 40

[56] References Cited

U.S. PATENT DOCUMENTS 2,682,676 7/1954 Franchi ..... 15/302

*Primary Examiner*—H. M. S. Sneed

*Attorney, Agent, or Firm*—Jerry N. Lulejian

[57] ABSTRACT

A method and apparatus for cleaning blinds which have a plurality of parallel, spaced slats where the method comprises the steps of (1) drawing the slats of the blind together, (2) immersing the blind in a container of liquid detergent, (3) rinsing the drawn blind with a rinsing liquid and (4) blowing the blind with a gas until it is substantially dry. The apparatus comprises a container containing a liquid detergent and capable of receiving the blind, a rinsing means for propelling rinsing liquid over the blind and drying means for blowing a gas over and through the blind until it is substantially dry.

9 Claims, 3 Drawing Sheets

METHOD AND APPARATUS FOR CLEANING MINI BLINDS

BACKGROUND OF INVENTION

The present invention relates to a method and apparatus for cleaning window blinds which have a plurality of parallel, spaced slats, and more particularly with cleaning mini blinds.

Before the present invention, those in the art of cleaning mini blinds chose to place the mini blind in its completely extended position within a deep tank of a detergent solution in which ultrasonic waves were transmitted in an attempt to loosen the dirt, dust, oil and greases normally found on mini blinds after they have been installed for even a short time. The ultrasonic bath technique has several disadvantages. First, and most importantly, it does not satisfactorily clean the slats of the dirt, dust, oils and greases which attach themselves to the slats electrostatically, mechanically and by adhesion to the oil and grease deposits. Second, ultrasonic bath apparatus are very expensive to produce, and because of the deep tanks necessary to receive completely extended mini blinds, such apparatus mobile. Thus, those wishing to have their mini blinds cleaned must remove them from their mountings, transport them to the ultrasonic bath (usually centrally located within a store selling mini blinds), and take the risk of damaging the mini blinds as well as incurring the inconvenience of assembling and disassembling the mini blinds from their mountings.

In order to make the ultrasonic cleaning apparatus mobile, some have made a shallow tank and place the mini blind in the tank with its slats drawn together. However, this method and apparatus gives inferior results because the ultrasonic waves cannot properly reach between the slats to loosen and remove the dirt.

The prior art ultrasonic bath apparatus and techniques which are capable of obtaining reasonable results teach to clean the mini blind while it is completely extended. Obviously, the prior art believed that by extending the mini blind, the surfaces of the individual slats may be better exposed to the detergent solution and the ultrasonic waves. Since mini blinds become noticeably soiled very quickly, it is practically impossible to properly clean a mini blind by hand, and since the ultrasonic bath inventions of the prior art are so expensive, it can be seen that the best the prior art had to offer was the ultrasonic bath invention.

However, the present invention cleans mini blinds under an entirely new approach which cleans the mini blinds significantly better than the best of the prior art inventions, costs much less to produce the apparatus, allows the apparatus to be made mobile so that it may be installed in a truck and moved to the locations of the mini blinds, and significantly lessens the time necessary to clean a mini blind.

SUMMARY OF INVENTION

The present invention relates to a method and apparatus for the cleaning of window blinds which have a plurality of parallel, spaced slats and are typically the mini blind now very popular as a window blind. The method of the present invention typically has the steps of (1) drawing the slats of the blind together, (2) immersing the blind in a container of liquid detergent, (3) rinsing the drawn blind with a rinsing liquid and (4) blowing the blind with a gas until it is substantially dry.

The method may also contain the steps of circulating the liquid detergent within the container, heating the liquid detergent in a container, immersing the blind in a second container which contains a liquid which at least coats the immersed portion of the drawn blind and leaves a sheen thereon. The step of blowing the blind with a gas may also comprise the step of directing compressed air over and through the slats of the blind.

The apparatus of the present invention generally comprises a container containing a liquid and capable of receiving the blind while the slats of the blind are drawn together, a rinsing means for propelling a rinsing liquid over the blind and a drying means for blowing a gas over the blind while the slats are drawn together. The apparatus of the present invention may also include a means for circulating a liquid detergent in the container, a means for heating the liquid detergent in the container, and a second container containing a liquid which at least coats the blind and leaves a sheen thereon and is capable of receiving the blind. The drying means may also comprise a means for blowing a compressed air over the blind and through the slats thereof.

DETAILED DESCRIPTION OF THE INVENTION

Figure 1A:
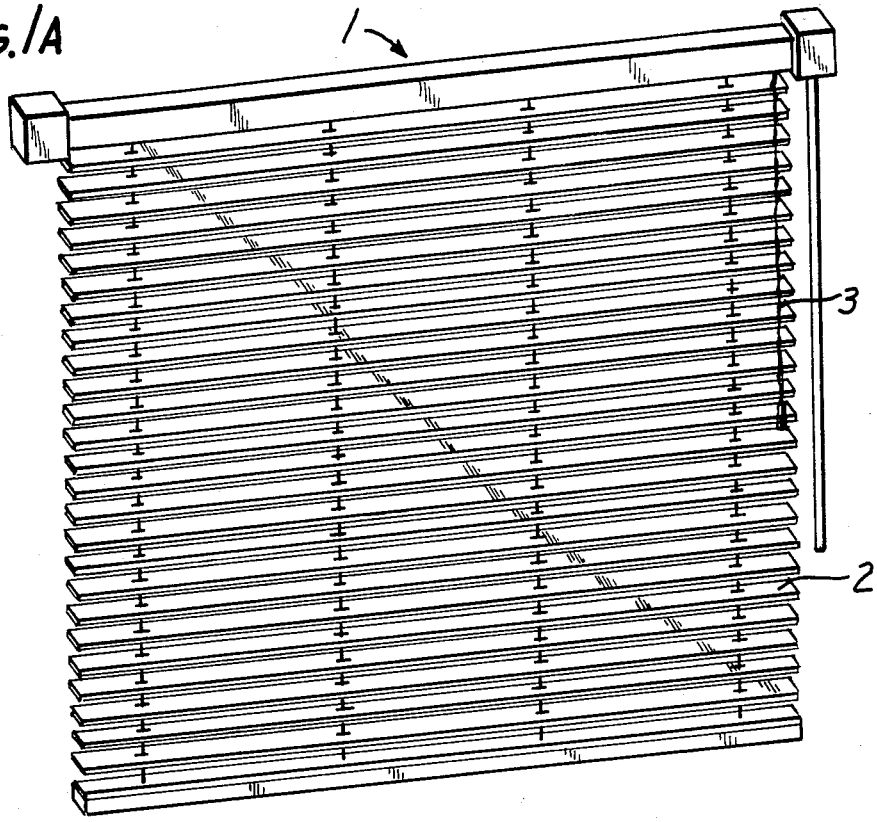
FIG. 1A is a perspective view of a mini blind which is the typical blind cleaned with the apparatus and method of the present invention.

The present invention relates to a method and apparatus for cleaning any window blinds which have a plurality of parallel, spaced slats, which are typically a mini blind 1 of the type shown in FIG. 1A but may be used with any blind having a plurality of parallel spaced slats. Therefore, when there is a reference herein to a mini blind, it also refers to any blind having a plurality of parallel suspended slats.

Before the present invention, those in the art of cleaning mini blinds chose to place the mini blind in its completely extended position within a deep tank of a detergent solution wherein ultrasonic waves are transmitted in an attempt to loosen the dirt, dust, oils and greases normally found on mini blinds after they have been installed for even a short time. The ultrasonic bath technique has several disadvantages. First, and most importantly, it does not satisfactorily clean the slats of the dust which attaches itself to the slats electrostatically, mechanically and by adhesion to the deposited oils and greases. Second, ultrasonic bath apparatus are very expensive to produce, and because of the deep tanks necessary to receive completely extended mini blinds, such apparatus are not mobile. Thus, those wishing to have their mini blinds cleaned must remove them from their mountings, transport them to the ultrasonic bath (usually centrally located within a store selling mini blinds), and take the risk of damaging the mini blinds as well as incurring the inconvenience of assembling and disassembling the mini blinds from their mountings.

In order to make the ultrasonic cleaning apparatus mobile, some have made a shallow tank and placed the mini blind in the tank with its slats drawn together. However, this method and apparatus gives inferior results because the ultrasonic waves cannot properly reach between the slats to loosen and remove the dirt.

The prior art ultrasonic bath apparatus and techniques capable of reasonable results teach to clean the mini blind while it is completely extended. Obviously, the prior art believed that by extending the mini blind, the surfaces of the individual slats may be exposed to the detergent solution and the ultrasonic waves to better clean the blind. However, such is not the case as will be seen after the description of the present invention. It is practically impossible to properly clean a mini blind by hand, and since the ultrasonic bath inventions of the prior art are so expensive and so prevalent, it can be seen that the best prior art had to offer was the ultrasonic bath invention.

The present invention cleans mini blinds under an entirely new approach which cleans the mini blinds significantly better than the best of the prior art inventions, costs much less to produce the apparatus, allows the apparatus to be made mobile so that it may be installed in a truck and moved to the locations of the mini blinds, and significantly lessens the time necessary to clean the blind.

Figure 1B:
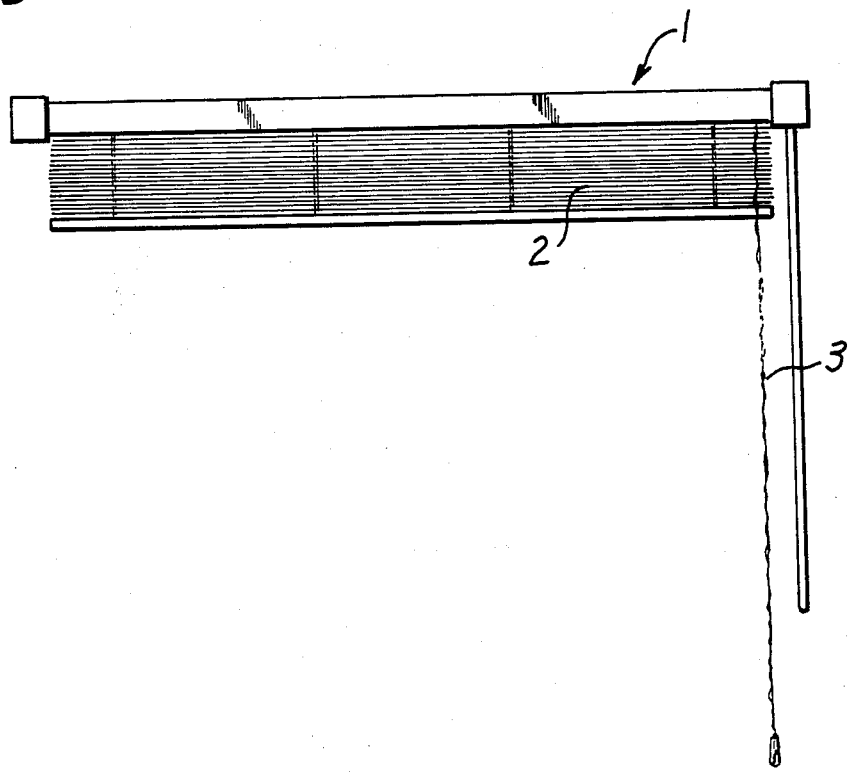
FIG. 1B is a front elevational view of the mini blind of FIG. 1A with the slats thereof drawn together in their tightest relationship.

Referring specifically to FIG. 1B, the mini blind 1 is shown with its slats 2 drawn together in substantially their closest relationship via drawstring 3. The unique approach of the present invention is to draw the slats 2 of the mini blind together in substantially their tightest relationship and perform certain cleaning steps described below. The prior art never conceived that a mini blind could be cleaned at all with the slats substantially touching each other in their fully compressed position, and certainly did not conceive that a mini blind could be cleaned better, faster and with much less expensive apparatus.

Figure 2A:
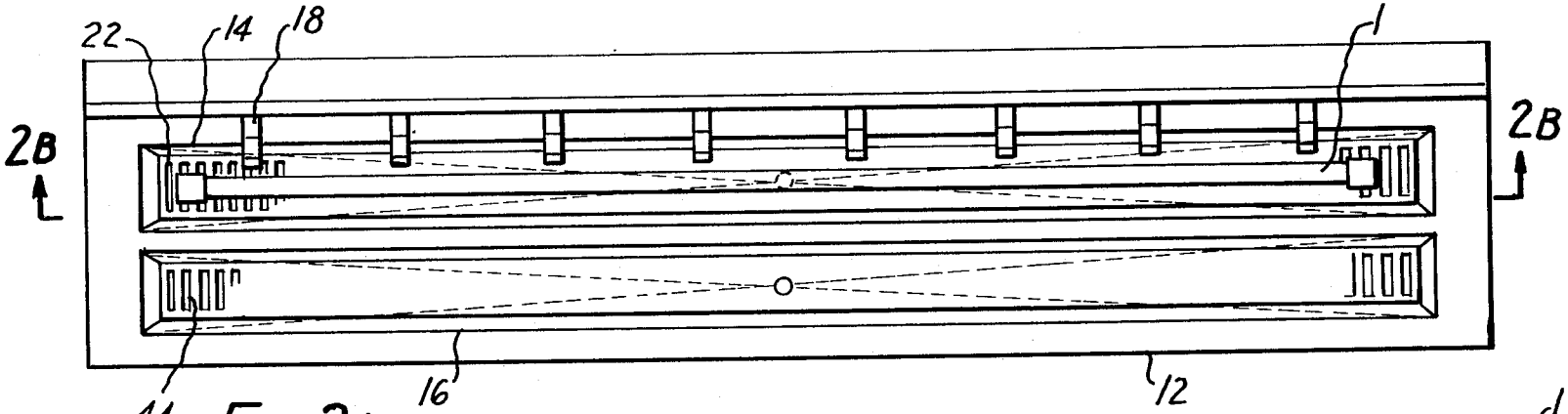
FIG. 2A is a top view of the rinsing tank, washing tank and rack of the apparatus of the present invention.
Figure 2C:
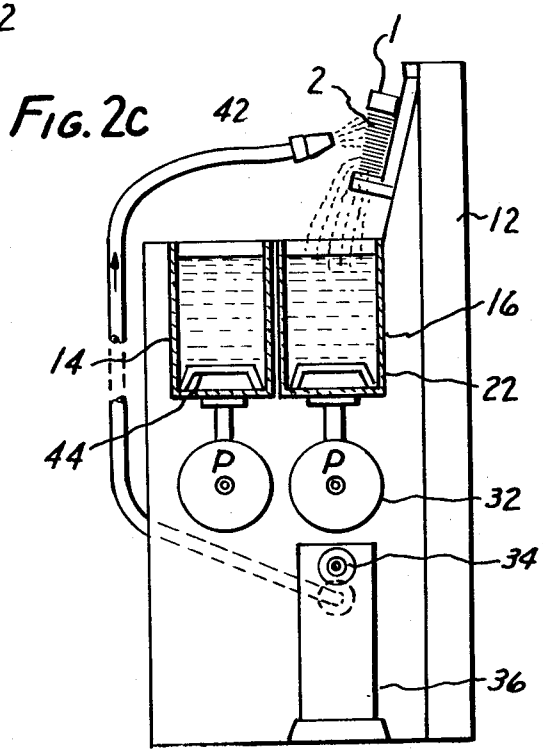
FIG. 2C is a side elevational cut-away view along line 2C—2C showing the rinsing means of the present apparatus invention.

Referring now to FIG. 2A, the present apparatus invention is preferably comprised of a housing 12 which supports a rinsing tank 14, a washing tank 16 and a rack 18 preferably comprised of a number of rack elements. Referring specifically to FIG. 2B, a front elevational cut-away view of the housing 12 along line 2B—2B is shown. FIG. 2B shows a cut-away of the washing tank 16. Preferably, the washing tank 16 has within it a liquid detergent solution at a level high enough to completely immerse a raised grate 22 and the mini blind 1. The raised grate 22 holds the mini blind above the bottom 24 of the washing tank 16 in order to isolate the mini blind 1 from any dirt deposited in the bottom 24 of the washing tank 16. The washing tank 16 also preferably has a drain 26 approximately at its center point which allows the liquid detergent to spill into plumbing 28 which is preferably of an "T" configuration. The "T" configured plumbing 28 allows the liquid detergent to first flow to a thermostatically controlled heater 30 which heats the liquid detergent and allows the liquid detergent to flow to a circulation pump 32. The circulating pump 32 forces the liquid detergent through a filter 38 (to remove any dirt from the liquid detergent) and back into a washing tank 16. In addition, some of the liquid detergent is forced into a washing pump 36 via piping 34.

Referring specifically to FIG. IB, the first step of a preferred method of the present invention is to collapse the slats 2 of the mini blind 1 together in their tightest interrelation via drawstring 3.

Referring to FIGS. 2A and 2B, the next step is to place the mini blind 1 in the washing tank 16. The compressed mini blind 1 is placed on the grate 22 in the washing tank 16, and the heated liquid detergent is allowed to circulate over and through the slats 2 and other portions of the mini blind 1.

The next step of the preferred method of the present invention is, after leaving the mini blind 1 in the washing tank 16 for approximately 30 seconds, to place the mini blind 1 on the rack 18 and (referring specifically to FIG. 2C) turn on a hose 42 from the washing pump 36 and direct the spray from the hose 42 over the mini blind 1 and through the slats 2. The liquid detergent from the washing tank 16 is thus circulated through hose 42, against rack 18 and back into washing tank 16 after it has rinsed mini blind 1.

Referring specifically to FIG. 2A, after the mini blind 1 is thoroughly rinsed with a liquid detergent via hose 42, it is placed in rinse tank 14 (not shown) which preferably contains a liquid sufficiently deep to submerge the mini blind 1 and the raised grate 44. The liquid in the rinse tank 14 preferably is one which is a mild detergent, one which will leave a coating on the mini blind 1 and its slats 2, and one which, when dried, will provide a sheen to the mini blind 1 and its slats 2. Preferably, the mini blind 1 is left in the rinse tank 14 for approximately 30 seconds. In order to heat and circulate the liquid in the rinsing tank 14, the rinse tank 14 preferably has the same plumbing, heating, filtering, and circulating apparatus (unshown) of the washing tank 16 with the exception of the washing pump 36, "T" configured plumbing 28 and hose 42.

Figure 2D:
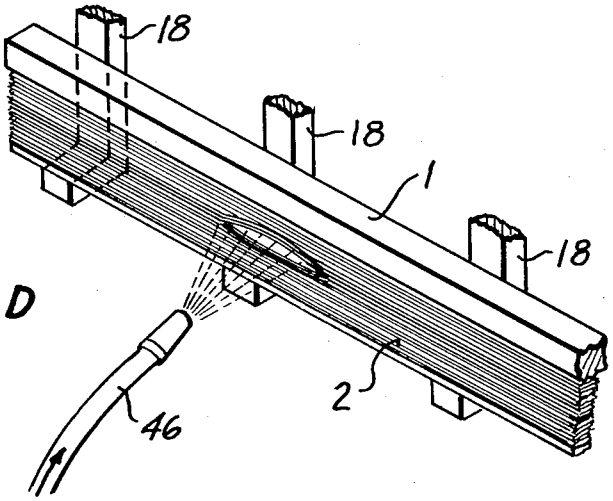
FIG. 2D is a perspective view of the mini blind installed on the rack of the present invention with a compressor hose drying the slats of the mini blind.
Figure 2B:
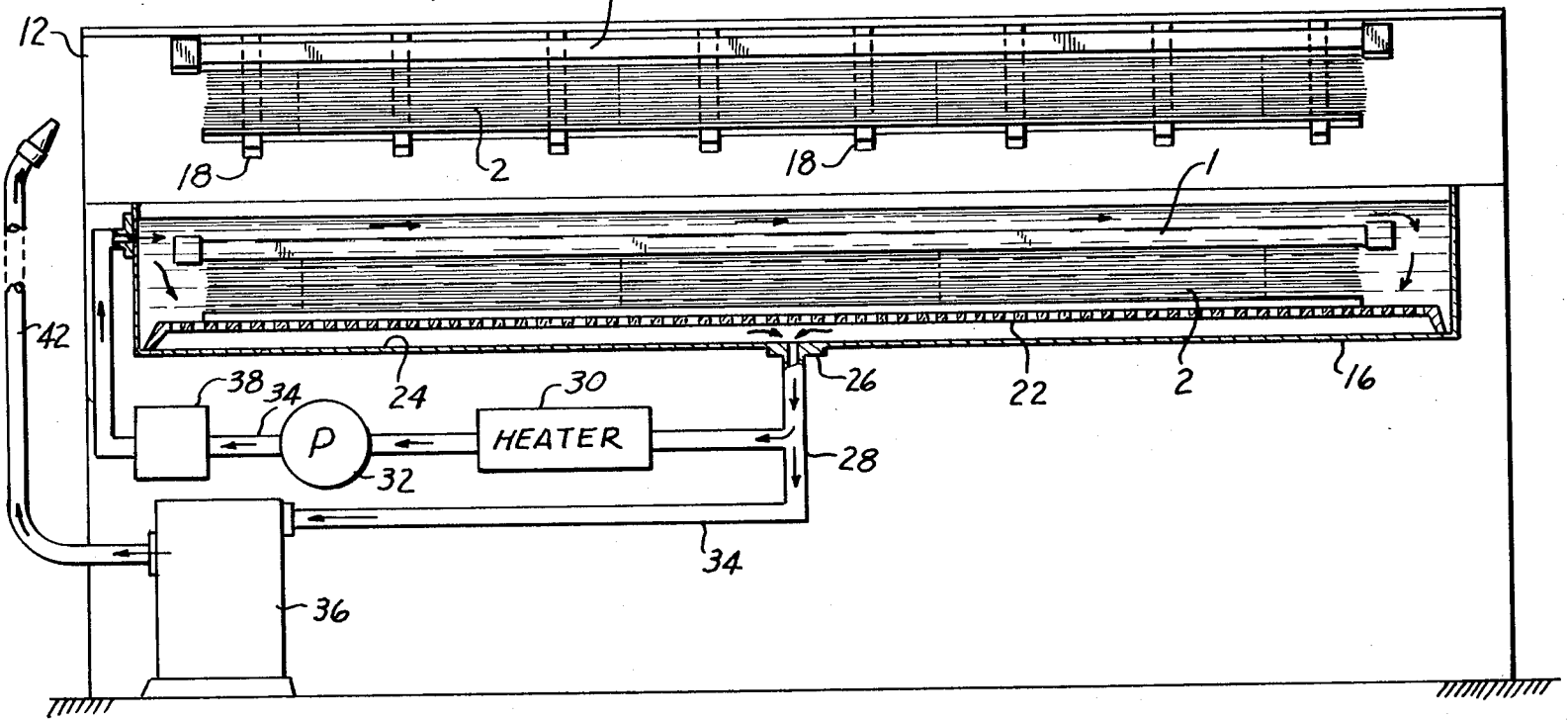
FIG. 2B is a front elevational cut-away view along line 2B—2B showing the plumbing underneath the washing tank.

Referring specifically to FIG. 2D, the next step of the preferred method of the present invention is to place the mini blind 1 on rack 18 and blow compressed air via hose 46 over mini blind 1 and through its slats 2 until the slats 2 and other portions of the mini blind 1 are substantially dry.

The washing tank 16 and the rinsing tank 14 are preferably 12 inches deep, 8 inches wide and 9 feet long, allowing each of them to hold more than 15 gallons quite easily. The liquid detergent in the washing tank 16 is preferably 15 gallons of deionized water mixed with 15 ounces of a concentrated soap composition sold by the Wax Shop, Inc. of Bakersfield, Calif. under the tradename of "WASH & SHINE" and 15 ounces of a concentrated detergent and degreasing composition sold by the Fuller Brush Company of Great Bend, Ks. as product No. 9411 under the trademark "SPRAY 'N AWAY". The Fuller concentrated detergent is believed to promote most of the cleaning of the mini blind 1 while the "WASH & SHINE" concentrated soap aids the washing process, and, because "WASH & SHINE" has a sheening element known as "PROMENE", it acts to coat the surfaces of the slats 2 and other portions of mini blind 1 to provide a sheen to the mini blind 1 when it is dried.

The liquid in the rinse tank is preferably 15 gallons of deionized water and 15 ounces of "WASH & SHINE", the concentrated soap and coating agent described above. The rinsing tank 14 is the last opportunity to remove the dirt, dust, oil and greases which was not removed in the previous steps and more pronounceably coats the slats 2 and other portions of the mini blind 1 with the "PROMENE" ingredient which provides the sheen to the mini blind 1 after it is dried and acts to repel dust on the mini blind 1 after it is reinstalled.

The exact formulas for the Fuller "SPRAY 'N AWAY" and the concentrated soap "WASH 'N SHINE" are trade secreted and unknown except that the "SPRAY 'N AWAY" contains 2 butoxyethanol and sodium metasilicate. Photocopies of the labels of these two products are attached hereto as Exhibits "A" and "B" and incorporated herein by this reference as if fully set forth.

In the preferred embodiment of the apparatus of the present invention, the washing pump 36 is preferably a ¾ horse power "Grundfas" pump which works on 115 volts AC and develops approximately 50 pounds per square inch of pressure through the hose 42. The circulating pump 32 of the washing tank 16 and for rinse tank 14 (unshown) are preferably 1/5 horse power "Grundfas" circulating pumps which work on 115 volts AC and pump approximately 5 gallons per minute. The thermostatically controlled heater 30 of the washing tank 16 and for rinse tank 14 are preferably in-line "SCEPTER" heaters working on 120 volts AC with the thermostat preferably set to 100 degrees Fahrenheit.

The air compressor (unshown) used to provide the compressed air through hose 46 is preferably an "ERMACO" air compressor which works on 110 volts AC and develops approximately 145 pounds per square inch of pressure. The washing tank 16, rinse tank 14, all associated plumbing and fixtures which touch the liquid detergent or rinsing liquid are preferably made of stainless steel or plastic in order to minimize the corrosive effect of the deionized water.

The present apparatus invention is configured as shown in FIGS. 2A, 2B, 2C and 2D primarily because it is intended to be installed within a GMC 1-ton step van truck (unshown) and powered by an 8.5 kilowatt generator (unshown) so that the present apparatus and method may be practiced at the location where the mini blinds are located.

As can be seen from the preceding discussion of the preferred embodiment of the apparatus and method of the present invention, what most significantly sets the present invention apart from the prior art is that the mini blind 1 has its slats 2 in their fully compressed position during the steps of the present method. Surprisingly, it is apparently the compressed position of the slats 2 of the mini blind 1 which most especially allows the liquid detergent to be forced between the compressed slats 2 to better remove the dirt, dust, oils and greases thereon because of the compressive forces focused and intensified between each slat 2. This is also true of compressed air flowing through the slats 2 which is intensified and compressed, thus causing the mini blind 1 to be dried faster and leave no residues.

The preceding description of a preferred embodiment of the apparatus and method of the present invention is for illustrative purposes only and shall not be considered as the full extent and scope of the present invention. Instead, the scope of the present invention shall be determined by reference to the following claims and their equivalents.

I claim:

1. In connection with a window blind having a plurality of parallel, spaced slats, a method of cleaning at least a portion of the blind, comprising the following steps:

drawing the slats of the blind together so that the slats are substantially stacked one on top of the other;

immersing at least the portion of the drawn blind to be cleaned in a container of liquid detergent;

rinsing the drawn blind with a rinsing liquid; and, blowing the drawn blind with a gas until it is substantially dry.

2. The method in accordance with claim 1 further comprising the step of circulating the liquid detergent within the container.

3. The method in accordance with claim 2 further comprising the step of heating the liquid detergent in the container.

4. The method in accordance with claim 3 further comprising, after the step of rinsing the drawn blind and before the step of blowing the blind with a gas, the step of immersing at least the portion of the blind to be cleaned in a second container which contains a liquid which at least coats the immersed portion of the drawn blind and leaves a sheen thereon.

5. The method in accordance with claim 4 in which the step of blowing the blind with a gas until the blind is substantially dry comprises directing compressed air at least over the portions of the blind to be cleaned.

6. The method in accordance with claim 5 in which the rinsing liquid is the liquid detergent.

7. In connection with a window blind having a plurality of parallel, spaced slats, an apparatus for cleaning at least a portion of the blind, comprising:

a container containing a liquid detergent and capable of receiving at least the portion of the blind to be cleaned while the slats of the blind are drawn together;

a rinsing means for propelling a rinsing liquid over at least the portion of the blind to be cleaned;

a drying means for blowing at least the portion of the blind to be cleaned with a gas while the slats of the blind are drawn together; and, a means for circulating the liquid detergent in the container.

8. The apparatus in accordance with claim 7 further comprising a means for heating the liquid detergent in the container.

9. The apparatus in accordance with claim 8 in which the drying means further comprises a compressed air means for directing compressed air over at least the portion of the blind to be cleaned

* * * * *